US011143202B2

(12) United States Patent
Nagase et al.

(10) Patent No.: US 11,143,202 B2
(45) Date of Patent: Oct. 12, 2021

(54) BLOWER DEVICE

(71) Applicant: MITSUBA Corporation, Gunma (JP)

(72) Inventors: Hiroki Nagase, Gunma (JP); Hidetake Ota, Gunma (JP)

(73) Assignee: MITSUBA Corporation, Gunma (JP)

( * ) Notice: Subject to any disclaimer, the term of this patent is extended or adjusted under 35 U.S.C. 154(b) by 53 days.

(21) Appl. No.: 16/625,759

(22) PCT Filed: Aug. 22, 2018

(86) PCT No.: PCT/JP2018/030950
§ 371 (c)(1),
(2) Date: Dec. 22, 2019

(87) PCT Pub. No.: WO2019/054141
PCT Pub. Date: Mar. 21, 2019

(65) Prior Publication Data

US 2020/0124054 A1 Apr. 23, 2020

(30) Foreign Application Priority Data

Sep. 14, 2017 (JP) ..... JP2017-176751

(51) Int. Cl.
*F04D 29/54* (2006.01)
*F04D 29/52* (2006.01)
(Continued)

(52) U.S. Cl.
CPC ..... *F04D 29/541* (2013.01); *F04D 29/522* (2013.01); *F04D 29/703* (2013.01); *F04D 19/002* (2013.01)

(58) Field of Classification Search
CPC .... F04D 29/522; F04D 29/541; F04D 29/281; F04D 29/444; F04D 29/703; F04D 25/08; F04D 25/0613; F04D 19/002
See application file for complete search history.

(56) References Cited

U.S. PATENT DOCUMENTS 6,874,990 B2 * 4/2005 Nadeau ..... F04D 29/164 415/173.5
9,249,788 B2 * 2/2016 Kimura ..... F04B 17/03
(Continued)

FOREIGN PATENT DOCUMENTS

JP H0683993 12/1994
JP 2000110773 4/2000
(Continued)

OTHER PUBLICATIONS

"International Search Report (Form PCT/ISA/210) of PCT/JP2018/030950", dated Nov. 20, 2018, with English translation thereof, pp. 1-4.
(Continued)

*Primary Examiner* — Richard A Edgar
*Assistant Examiner* — Jackson N Gillenwaters
(74) *Attorney, Agent, or Firm* — JCIPRNET

(57) ABSTRACT

A blower device includes a motor having an output shaft and a housing; a fan rotationally driven by the motor; and a shroud having a shroud body with a fan installation hole, and a motor mounting part for mounting the motor arranged inside the fan installation hole when viewed in an axial direction of the output shaft. The motor mounting part includes an inner cylinder surrounding a periphery of the motor from a radial outer side of the output shaft; an outer cylinder surrounding the inner cylinder from the radial outer side; and spokes connecting the inner and the outer cylinders. The inner cylinder includes a top wall covering the motor from above while the shroud is fixed. A back end edge of the top wall, which is located on a positive pressure side when the fan is rotated, is located closer to the positive pressure side than the housing.

11 Claims, 7 Drawing Sheets

(51) Int. Cl.
*F04D 29/70* (2006.01)
*F04D 19/00* (2006.01)

(56) References Cited

U.S. PATENT DOCUMENTS

| | | | | |
|---|---|---|---|---|
| 9,869,321 | B2 * | 1/2018 | Ishihara | F04D 19/002 |
| 2011/0027075 | A1 * | 2/2011 | Nogami | F04D 29/083 415/182.1 |
| 2011/0259558 | A1 * | 10/2011 | Colpan | F01P 5/06 165/121 |
| 2018/0128286 | A1 * | 5/2018 | Schafer | F04D 29/584 |
| 2019/0085866 | A1 * | 3/2019 | Ota | F01P 5/06 |

FOREIGN PATENT DOCUMENTS

| | | |
|---|---|---|
| JP | 2010132183 | 6/2010 |
| JP | 2015086750 | 5/2015 |
| JP | 2017110563 | 6/2017 |

OTHER PUBLICATIONS

"International Preliminary Report On Patentability (Form PCT/IPEA/409) of PCT/JP2018/030950," dated Aug. 5, 2019, with English translation thereof, pp. 1-7.

* cited by examiner

BLOWER DEVICE

CROSS-REFERENCE TO RELATED APPLICATION

This application is a 371 application of the International PCT application serial no. PCT/JP2018/030950, filed on Aug. 22, 2018, which claims the priority benefit of Japan Patent Application No. 2017-176751, filed on Sep. 14, 2017. The entirety of each of the abovementioned patent applications is hereby incorporated by reference herein and made a part of this specification.

BACKGROUND OF THE INVENTION

Technical Field

The present invention relates to a blower device.

Related Art

Conventionally, there is a blower device which uses a fan to cool a vehicle radiator. This kind of blower device rotates the fan with the power of a drive source, and cools the radiator, for example, by sucking air via the radiator (for example, see patent literature 1: Japanese Patent Application Laid-Open No. 2015-86750). This blower device includes a shroud for guiding the air to the fan. The shroud includes a fan installation hole for accommodating the fan, and a drive source mounting part to which a drive source is mounted in the fan installation hole when viewed from the direction of air flow. The drive source mounting part is formed, for example, into a cylindrical shape following the external shape of the drive source and is formed to surround the drive source.

SUMMARY

Problems to be Solved

Meanwhile, the drive source mounting part is arranged in an opening when viewed from the direction of air flow, and thus may block air delivery of the fan. Therefore, the drive source mounting part desirably has a configuration in which blocking of the air delivery of the fan is suppressed. However, by suppressing the blocking of the air delivery of the fan, a wind speed increases near the drive source mounting part. Therefore, water such as rainwater and the like may flow around the drive source mounting part, and the amount of the water covering the drive source surrounded by the drive source mounting part may increase.

Therefore, the present invention provides a blower device capable of securing an air delivery rate and reducing water covering a drive source.

Means to Solve Problems

A blower device of the present invention includes a drive source having an output shaft and a housing; a fan connected to the output shaft and rotationally driven by the drive source; and a shroud having a shroud body in which a fan installation hole for accommodating the fan is formed, and having a driven source mounting part which is arranged inside the fan installation hole when viewed in an axial direction of the output shaft and to which the drive source is mounted; the drive source mounting part includes an inner cylinder surrounding a periphery of the drive source from a radial outer side of the output shaft; an outer cylinder surrounding the inner cylinder from the radial outer side; and a plurality of spokes connecting the inner cylinder and the outer cylinder; the inner cylinder includes a top wall covering the drive source from above in a state that the shroud is fixed; and an end edge of the top wall, which is located on a positive pressure side when the fan is being rotated, is located closer to the positive pressure side than the housing.

According to the present invention, since the drive source mounting part includes the inner cylinder and the outer cylinder which are connected by the plurality of spokes, it is possible to make air flow between the inner cylinder and the outer cylinder. Accordingly, the air delivery performed by the fan is suppressed from being blocked by the drive source mounting part, and the air delivery rate can be secured.

Moreover, the inner cylinder includes the top wall covering the drive source from above, and the end edge of the top wall, which is located on the positive pressure side when the fan is being rotated, is located closer to the positive pressure side than the housing of the drive source. Therefore, due to the air flowing from the negative pressure side toward the positive pressure side, water falling from the end edge on the positive pressure side of the top wall falls closer to the positive pressure side than the housing of the drive source. Accordingly, the water covering the drive source can be reduced.

As described above, it is possible to provide a blower device capable of securing the air delivery rate and reducing the water covering the drive source.

A blower device of the present invention includes a drive source having an output shaft; a fan connected to the output shaft and rotationally driven by the drive source; and a shroud having a shroud body in which a fan installation hole for accommodating the fan is formed, and having a drive source mounting part which is arranged inside the fan installation hole when viewed in an axial direction of the output shaft and to which the drive source is mounted; the fan includes a boss part which is formed in a bottomed cylindrical shape and which is disposed to cover the drive source from one side in the axial direction of the output shaft; the drive source mounting part includes: an inner cylinder disposed closer to the other side in the axial direction than the boss part and surrounding the periphery of the drive source from a radial outer side of the output shaft; an outer cylinder surrounding the inner cylinder from the radial outer side; and a plurality of spokes connecting the inner cylinder and the outer cylinder; and a stretch part which stretches toward the radial outer side of the output shaft and extends along a peripheral direction of the output shaft is formed on an outer peripheral surface of the inner cylinder.

According to the present invention, since the drive source mounting part includes the inner cylinder and the outer cylinder which are connected by the plurality of spokes, it is possible to make air flow between the inner cylinder and the outer cylinder. Accordingly, the air delivery performed by the fan is suppressed from being blocked by the drive source mounting part, and the air delivery rate can be secured.

Moreover, the stretch part which stretches toward the radial outer side and extends along the peripheral direction is arranged on the outer peripheral surface of the inner cylinder. Accordingly, water splashing along the axial direction at the radial outer side of the outer peripheral surface of the inner cylinder can be received by the stretch part. Thereby, the water splashing from the inner cylinder side toward the boss part side in the axial direction can be suppressed from entering the space between the boss part and the drive source. Accordingly, the water covering the drive source can be reduced.

As described above, it is possible to provide a blower device capable of securing the air delivery rate and reducing the water covering the drive source.

A blower device of the present invention includes a drive source having an output shaft and a housing; a fan connected to the output shaft and rotationally driven by the drive source; and a shroud having a shroud body in which a fan installation hole for accommodating the fan is formed, and having a drive sourced mounting part which is arranged inside the fan installation hole when viewed in an axial direction of the output shaft and to which the drive source is mounted; the fan includes a boss part which is formed in a bottomed cylindrical shape and which is disposed to cover the drive source from one side in an axial direction of the output shaft; the drive source mounting part includes an inner cylinder disposed closer to the other side in the axial direction than the boss part and surrounding the periphery of the drive source from a radial outer side of the output shaft; an outer cylinder surrounding the inner cylinder from the radial outer side; and a plurality of spokes connecting the inner cylinder and the outer cylinder; the inner cylinder includes a top wall covering the drive source from above in a state that the shroud is fixed; an end edge of the top wall, which is located on a positive pressure side when the fan is being rotated, is located closer to the positive pressure side than the housing; and a stretch part which stretches toward the radial outer side of the output shaft and extends along a peripheral direction of the output shaft is formed on an outer peripheral surface of the inner cylinder.

According to the present invention, since the drive source mounting part includes the inner cylinder and the outer cylinder which are connected by the plurality of spokes, it is possible to make air flow between the inner cylinder and the outer cylinder. Accordingly, the air delivery performed by the fan is suppressed from being blocked by the drive source mounting part, and the air delivery rate can be secured.

Moreover, the inner cylinder includes the top wall covering the drive source from above, and the end edge of the top wall, which is located on the positive pressure side when the fan is being rotated, is located closer to the positive pressure side than the housing of the drive source. Therefore, due to the air flowing from the negative pressure side toward the positive pressure side, water falling from the end edge of the top wall on the positive pressure side falls closer to the positive pressure side than the housing of the drive source. Accordingly, the water covering the drive source can be reduced.

Furthermore, the stretch part which stretches toward the radial outer side and extends along the peripheral direction is arranged on the outer peripheral surface of the inner cylinder. Accordingly, water splashing along the axial direction at the radial outer side of the outer peripheral surface of the inner cylinder can be received by the stretch part. Thereby, the water splashing from the inner cylinder side toward the boss part side in the axial direction can be suppressed from entering the space between the boss part and the drive source. Accordingly, the water covering the drive source can be reduced.

As described above, it is possible to provide a blower device capable of securing the air delivery rate and reducing the water covering the drive source.

Effect

According to the present invention, it is possible to provide a blower device capable of securing an air delivery rate and reducing water covering a drive source.

DESCRIPTION OF THE EMBODIMENTS

An embodiment of the present invention is described below based on the diagrams.

Besides, front-back, up-down, and left-right orientations described below are the same as front-back, up-down, and left-right orientations in a vehicle unless otherwise noted; in the diagrams, an arrow UP represents an upward direction, an arrow FR represents a frontward (frontward of a travel direction) direction, and an arrow LH represents a leftward direction.

For example, a blower device 1 of the embodiment is loaded in an engine room of a car and cools a radiator. The radiator is disposed in front of an engine in the engine room, and the blower device 1 is mounted back of the radiator. Accordingly, the blower device is disposed between the radiator and the engine.

Figure 1:
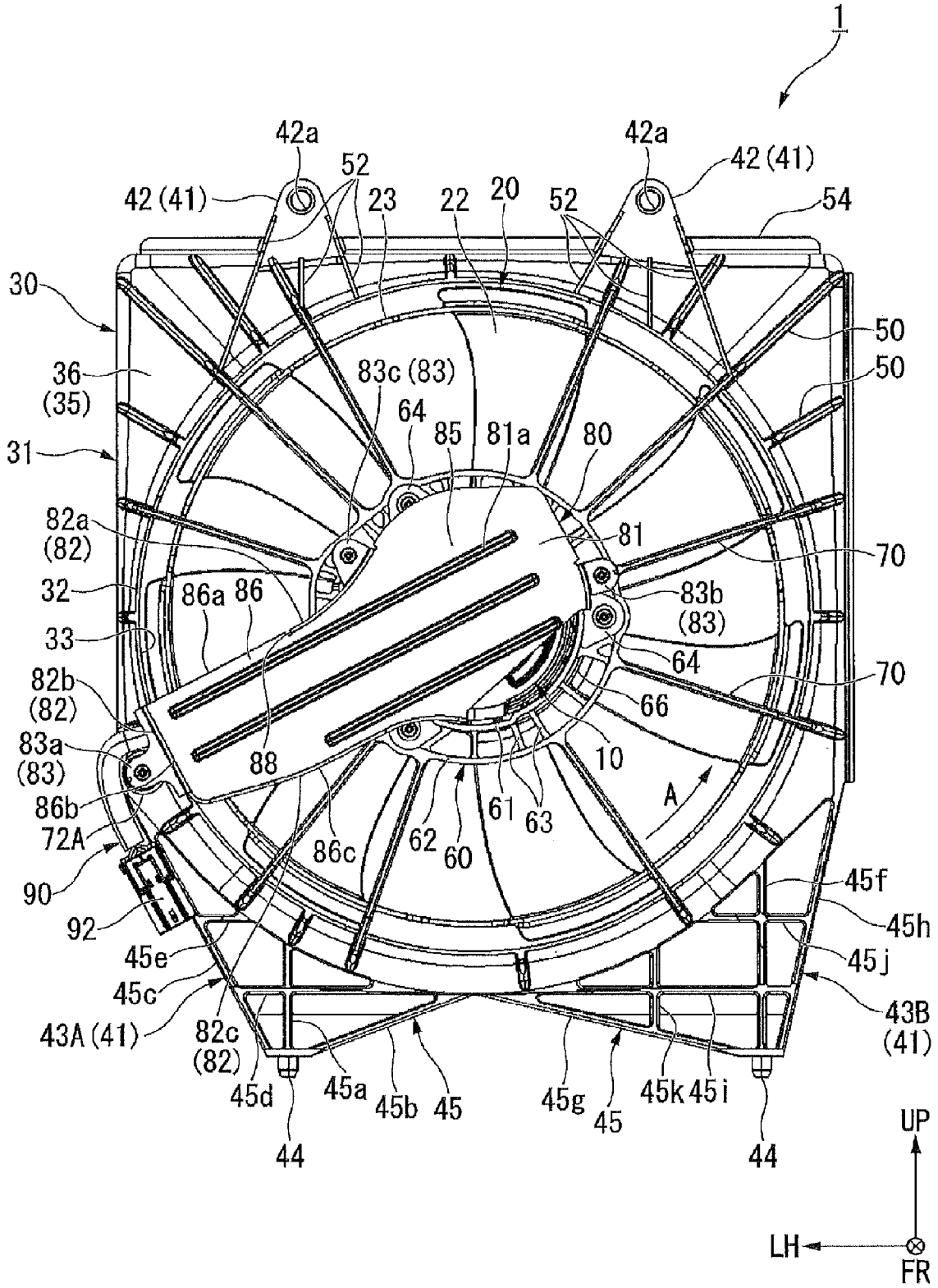
FIG. 1 is a rear view showing a blower device of an embodiment.

FIG. 1 is a rear view in which the blower device of the embodiment is viewed from the back.

As shown in FIG. 1, the blower device 1 includes a motor 10 which is a drive source, a fan 20 rotationally driven by the motor 10, a shroud 30 forming the outline of the blower device 1 and fixed to the radiator, a heat shield plate 80 which shields the motor 10 from the engine, and a wire harness 90 connected to the motor 10. Besides, front-back, up-down, and left-right orientations described below are the same as front-back, up-down, and left-right orientations in a state that the shroud 30 is fixed to the radiator (a fixed state of the shroud 30).

Figure 2:
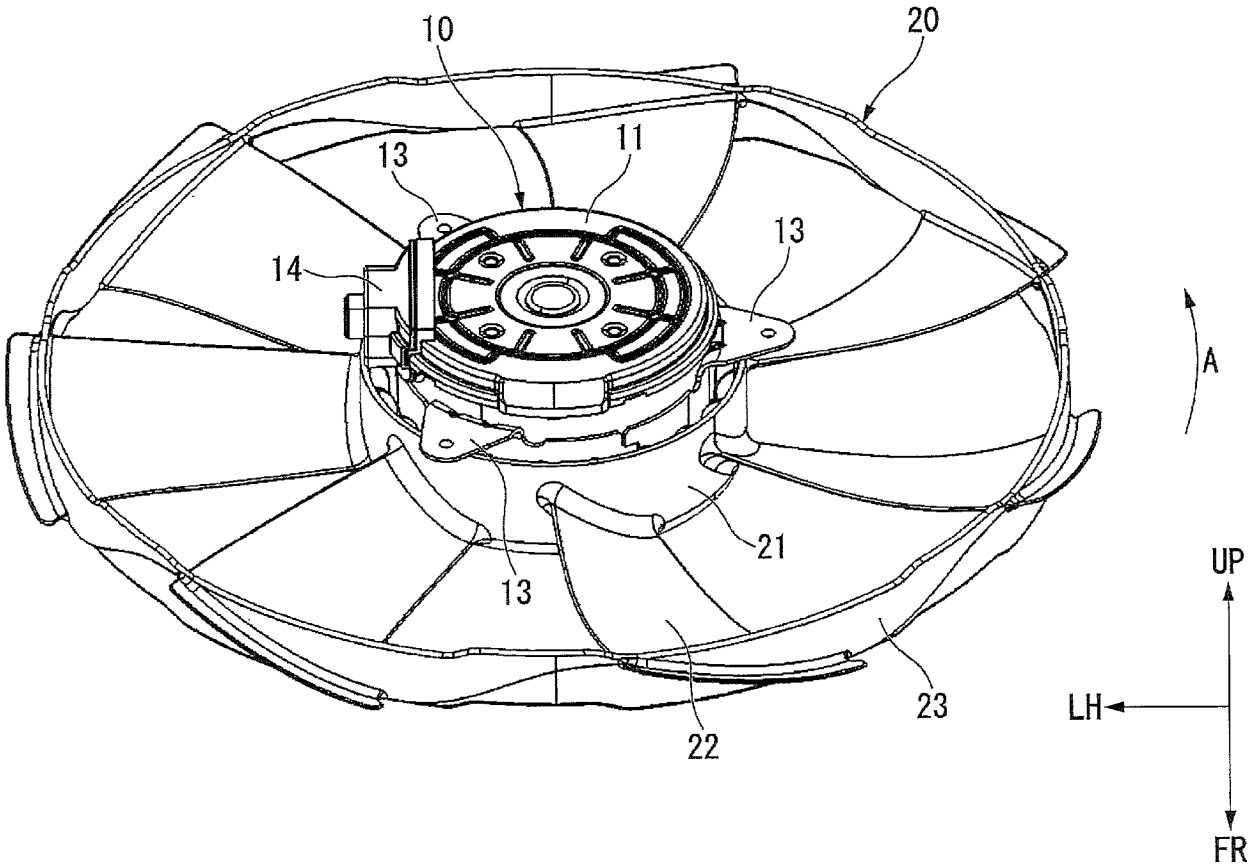
FIG. 2 is a perspective view showing a motor and a fan of the embodiment.

FIG. 2 is a perspective view showing the motor and the fan of the embodiment.

As shown in FIG. 2, the motor 10 includes a housing 11 for accommodating a stator and a rotor both of which are not shown, an output shaft 12 (see FIG. 6) protruding from the housing 11, a plurality of (three in the embodiment) fastening parts 13 extending from the housing 11, and a motor connector 14 fixed to the housing 11. The housing 11 is formed in a cylindrical shape coaxial with the output shaft 12. The output shaft 12 extends in the front-back direction and protrudes frontward from the housing 11 (see FIG. 6). That is, the axial direction of the output shaft 12 is in accordance with the front-back direction. The plurality of fastening parts 13 extends along the radial direction of the output shaft 12 (hereinafter simply referred to as the radial direction) from the outer peripheral surface of the housing 11. The plurality of fastening parts 13 is arranged at equiangular intervals in the peripheral direction of the output shaft 12 (hereinafter simply referred to as the peripheral direction). A through hole through which a screw is threaded is formed in each fastening part 13. The motor connector 14 is fixed to the back end of the housing 11. The motor connector 14 protrudes leftward from the peripheral surface of the housing 11.

The fan 20 is an axial-flow fan. The fan 20 is rotationally driven by the motor 10. The fan 20 is driven to suck air via the radiator and blows the sucked air toward the engine. The fan 20 includes a boss part 21 having a bottomed cylindrical shape and connected to the output shaft 12 of the motor 10 for power transmission, a plurality of (seven in the embodiment) blades 22 which is formed integrally with the boss part 21 and protrudes from the outer peripheral surface of the boss part 21 toward the radial outer side, and a ring member 23 having a cylindrical shape and connecting, in a ring shape, end regions of the plurality of blades 22 on the radial outer side. The boss part 21 is arranged coaxially with the output shaft 12 of the motor 10. The boss part 21 opens backward and accommodates the front end of the housing 11 of the motor 10 inside.

Each blade 22 is inclined to be directed to the front in the travel direction of the vehicle as the blade 22 is directed from the back to the front in the rotation direction of the fan 20 shown by an arrow A in FIG. 2. Accordingly, the back surface of the blade 22 is a positive pressure surface of which the neighbourhood section has a positive pressure when the fan 20 is being rotated, and the front surface of the blade 22 is a negative pressure surface of which the neighbourhood section has a negative pressure when the fan 20 is being rotated.

The ring member 23 connects, in a ring shape, positions offset radially inward than the ends of the blades 22 on the radial outer side. The ring member 23 is arranged coaxially with the output shaft 12 of the motor 10.

Figure 3:
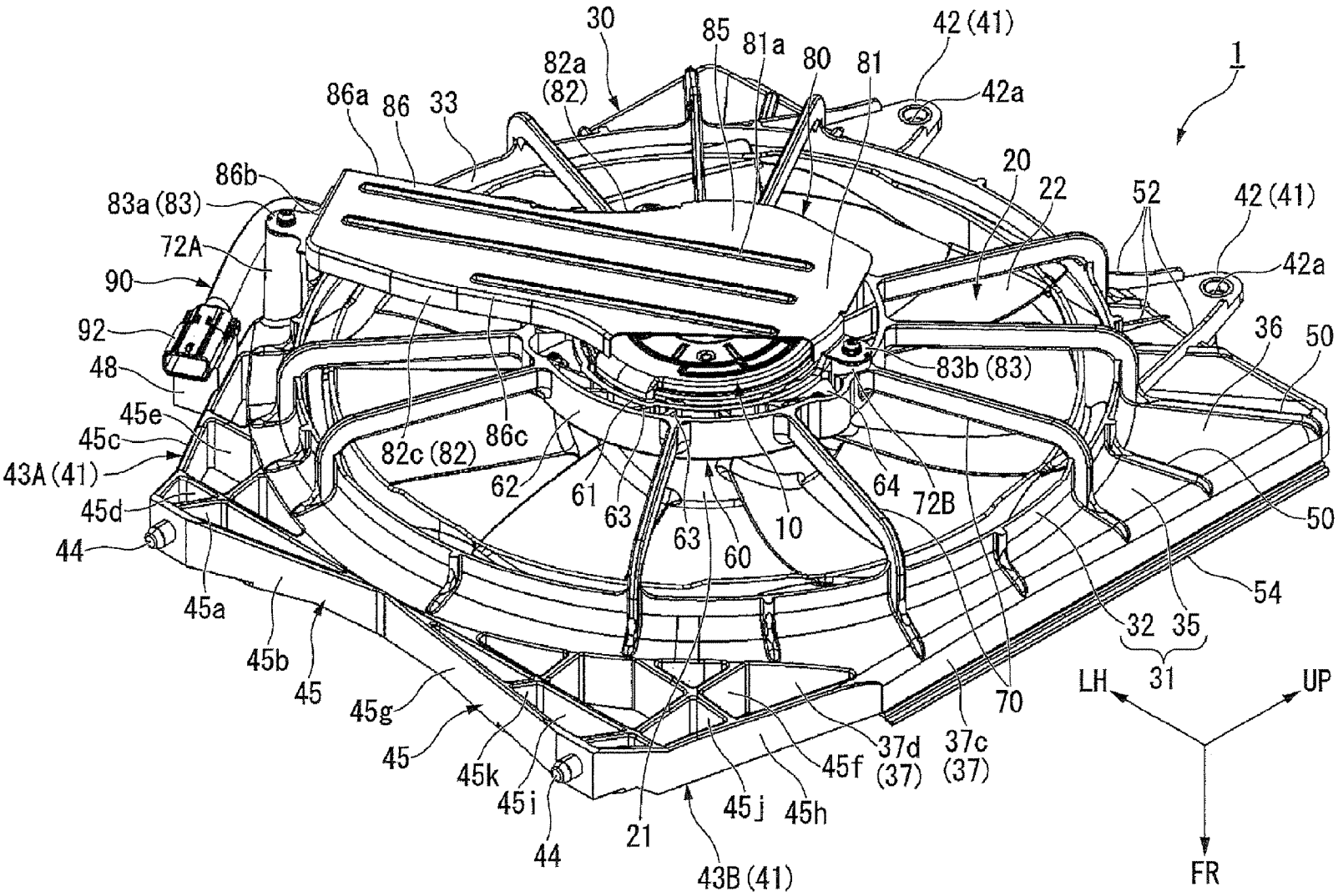
FIG. 3 is a perspective view showing the blower device of the embodiment.
Figure 4:
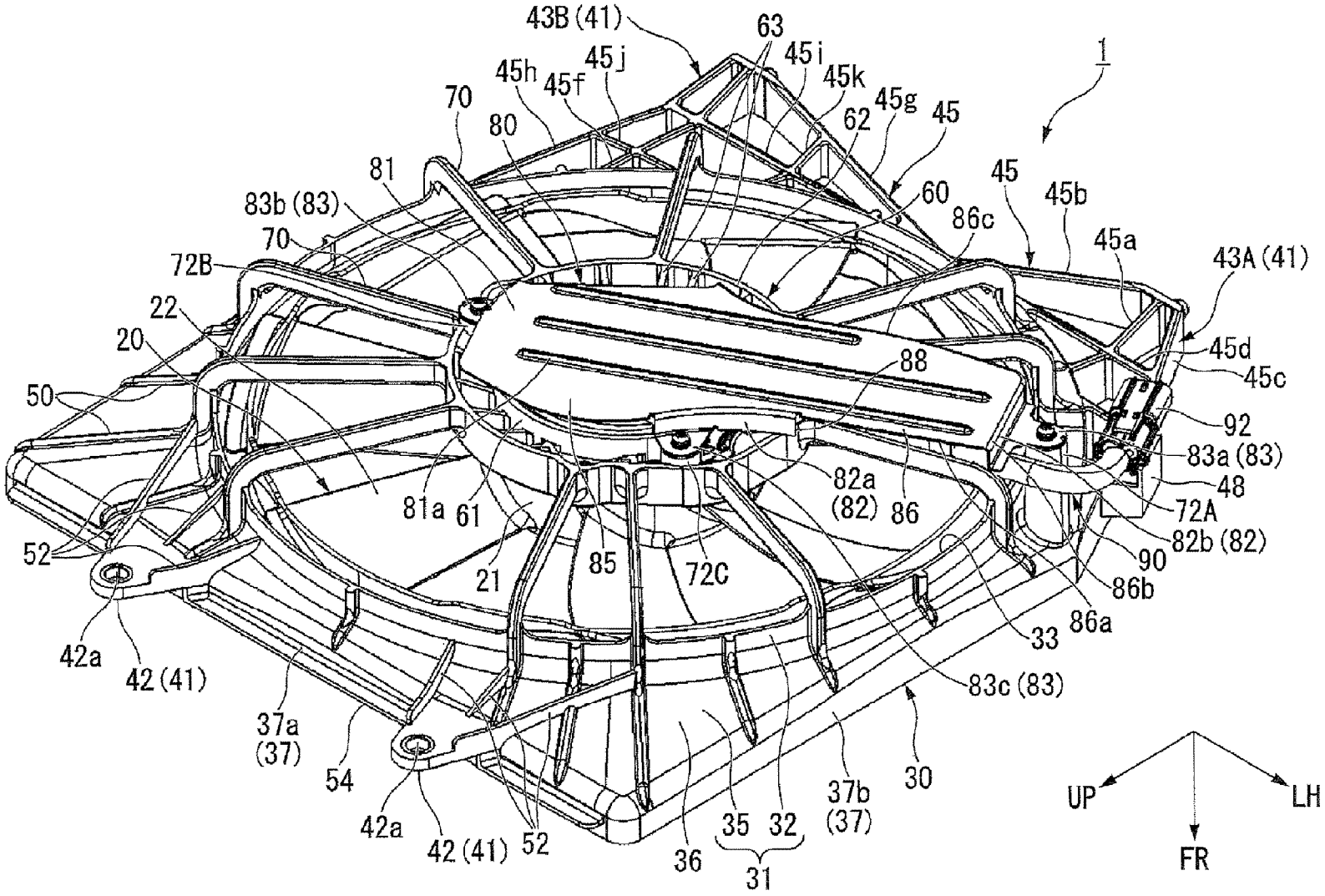
FIG. 4 is a perspective view showing the blower device of the embodiment.

FIG. 3 and FIG. 4 are perspective views showing the blower device of the embodiment.

As shown in FIG. 3 and FIG. 4, the shroud 30 is arranged to hold the motor 10 and cover the fan 20 from the outer peripheral side. The shroud 30 is a resin-molded member and is molded by injection molding using a metallic mold. The shroud 30 includes a shroud body 31 in which a fan installation hole 33 for disposing the fan 20 is formed; a radiator fixation part 41 arranged on the shroud body 31 and fixed to the radiator; a connector holding part 48 arranged on the shroud body 31 and holding a connector 92 of the wire harness 90; main ribs 50, reinforcement ribs 52, and a side wall rib 54 erected on the shroud body 31; a motor mounting part 60 (drive source mounting part) which is arranged inside the fan installation hole 33 when viewed from the front-back direction and to which the motor 10 is mounted; a plurality of stays 70 connecting the shroud body 31 and the motor mounting part 60; and a plurality of heat shield plate mounting seats 72A, 72B and 72C to which the heat shield plate 80 is mounted.

As shown in FIG. 3, the shroud body 31 includes a cylindrical part 32 and an air guide part 35.

The cylindrical part 32 is formed in a cylindrical shape coaxial with the output shaft 12 (see FIG. 6) of the motor 10. The fan installation hole 33 is formed on the inner side of the cylindrical part 32. The fan installation hole 33 is formed in a circular shape when viewed from the front-back direction. The cylindrical part 32 encloses the plurality of blades 22 of the fan 20.

The air guide part 35 guides the air sucked by the fan 20 toward the fan installation hole 33. The air guide part 35 includes a flange portion 36 which stretches radially outward from the front end edge of the cylindrical part 32, and a side wall portion 37 which extends frontward from the outer edge of the flange portion 36. For example, the flange portion 36 is formed in a shape corresponding to the shape of the radiator and faces the radiator in the front-back direction. As shown in FIG. 1, the upper end edge of the flange portion 36 extends along the left-right direction. The left and right side edges of the flange portion 36 respectively extend downward from the end of the upper end edge of the flange portion 36 in the up-down direction. The lower end edge of the flange portion 36 extends in an arc concentric with the output shaft 12 (see FIG. 6) of the motor 10. The connection part between the lower end edge of the flange portion 36 and the left and right side edges of the flange portion 36 is arranged below the central axis of the output shaft 12 of the motor 10 and above the lower end of the cylindrical part 32.

As shown in FIG. 3 and FIG. 4, the side wall portion 37 extends from the whole periphery of the outer edge of the flange portion 36. That is, the side wall portion 37 includes an upper side wall portion 37*a* extending from the upper end edge of the flange portion 36, a left side wall portion 37*b* extending from the left side edge, a right side wall portion 37*c* extending from the right side edge, and a lower side wall portion 37*d* extending from the lower end edge. The upper side wall portion 37*a*, the left side wall portion 37*b*, the right side wall portion 37*c*, and the lower side wall portion 37*d* are respectively connected to each other.

As shown in FIG. 1, the radiator fixation part 41 includes upper fixation parts 42 arranged at the upper portion of the shroud body 31, and lower fixation parts 43A, 43B arranged in the lower portion of the shroud body 31.

A pair of upper fixation parts 42 is arranged at the left and right with a space therebetween. The upper fixation parts 42 protrude upward from the flange portion 36. The upper fixation parts 42 are formed in a triangular shape when viewed from the front-back direction so that the width in the left-right direction decreases from the bottom to the top. The upper ends of the upper fixation parts 42 are rounded when viewed from the front-back direction. A through hole 42*a* through which a bolt is threaded is formed in each upper fixation part 42.

The lower fixation parts 43A, 43B are arranged at the left and right with a space therebetween. The lower fixation parts 43A, 43B are the lower left fixation part 43A arranged on the left side and the lower right fixation part 43B arranged on the right side. The lower fixation parts 43A, 43B include bosses 44 which are arranged at the lower end and protrude downward, and connection parts 45 which connect the bosses 44 to the lower side wall portion 37*d* (see FIG. 3) of the air guide part 35.

As shown in FIG. 3, the connection part 45 of each of the lower fixation parts 43A, 43B is formed of a plurality of tabular members extending from the lower side wall portion 37*d*. Specifically, the connection part 45 of the lower left fixation part 43A includes a first member 45*a*, a second member 45*b*, a third member 45*c*, a fourth member 45*d*, and a fifth member 45*e*. The first member 45*a* extends upward from the boss 44 along the up-down direction and is connected to the lower side wall portion 37*d*. The second member 45*b* extends rightward and upward from the boss 44 and is connected to the lower end of the lower side wall portion 37*d*. The third member 45*c* extends leftward and upward from the boss 44 and is connected to the connection part between the lower side wall portion 37*d* and the left side wall portion 37*b* (see FIG. 4). The fourth member 45*d* extends from the middle portion of the first member 45*a* to the left and right sides along the left-right direction. The fourth member 45*d* is connected to the third member 45*c* at the left end, and is connected to the lower side wall portion 37*d* at the right end. The fifth member 45*e* extends from the middle portion of the third member 45*c* to the right side along the left-right direction above the fourth member 45*d*, and is connected to the lower side wall portion 37*d*.

The connection part 45 of the lower right fixation part 43B includes a first member 45*f*, a second member 45*g*, a third member 45*h*, a fourth member 45*i*, a fifth member 45*j*, and a sixth member 45*k*. The first member 45*f* extends upward from the boss 44 along the up-down direction and is connected to the lower side wall portion 37*d*. The second member 45*g* extends leftward and upward from the boss 44 and is connected to the lower end of the lower side wall portion 37*d*. The third member 45*h* extends rightward and upward from the boss 44 and is connected to the connection part between the lower side wall portion 37*d* and the right side wall portion 37*c*. The fourth member 45*i* extends from the middle portion of the first member 45*f* to the left and right sides along the left-right direction. The fourth member 45*i* is connected to the third member 45*h* at the right end and is connected to the lower side wall portion 37*d* at the left end. The fifth member 45*j* extends from the middle portion of the third member 45*h* to the left and right sides along the left-right direction above the fourth member 45*i*. The fifth member 45*j* is connected to the third member 45*h* at the right end and is connected to the lower side wall portion 37*d* at the left end. The sixth member 45*k* extends from the fourth member 45*i* to the up and down sides along the up-down direction at the left of the first member 45*f*. The sixth member 45*k* is connected to the second member 45*g* at the lower end and is connected to the lower side wall portion 37*d* at the upper end.

As shown in FIG. 4, the connector holding part 48 is arranged on the side surface of the connection part 45 of the lower left fixation part 43A. The connector holding part 48 is formed in a rectangular parallelepiped box shape. The connector holding part 48 protrudes radially outward from the third member 45*c* of the connection part 45 of the lower left fixation part 43A.

As shown in FIG. 1, a plurality of main ribs 50 is arranged. The main ribs 50 are erected across the outer peripheral surface of the cylindrical part 32 and the back surface of the flange portion 36. The main ribs 50 respectively extend radially from the cylindrical part 32 along the radial direction. More main ribs 50 are arranged than the stays 70.

As shown in FIG. 4, a plurality of (three in the embodiment) reinforcement ribs 52 is arranged for each upper fixation part 42. The reinforcement ribs 52 are erected across the back surface of the flange portion 36 and the back surface of the upper fixation part 42. Each reinforcement rib 52 extends linearly. At least one of the reinforcement ribs 52 is connected to the end of the main rib 50 on the radial inner side at the end on the radial inner side.

The side wall rib 54 is erected on the upper side wall portion 37*a*. The side wall rib 54 extends along the left-right direction and is connected to the left and right ends of each upper fixation part 42.

Figure 5:
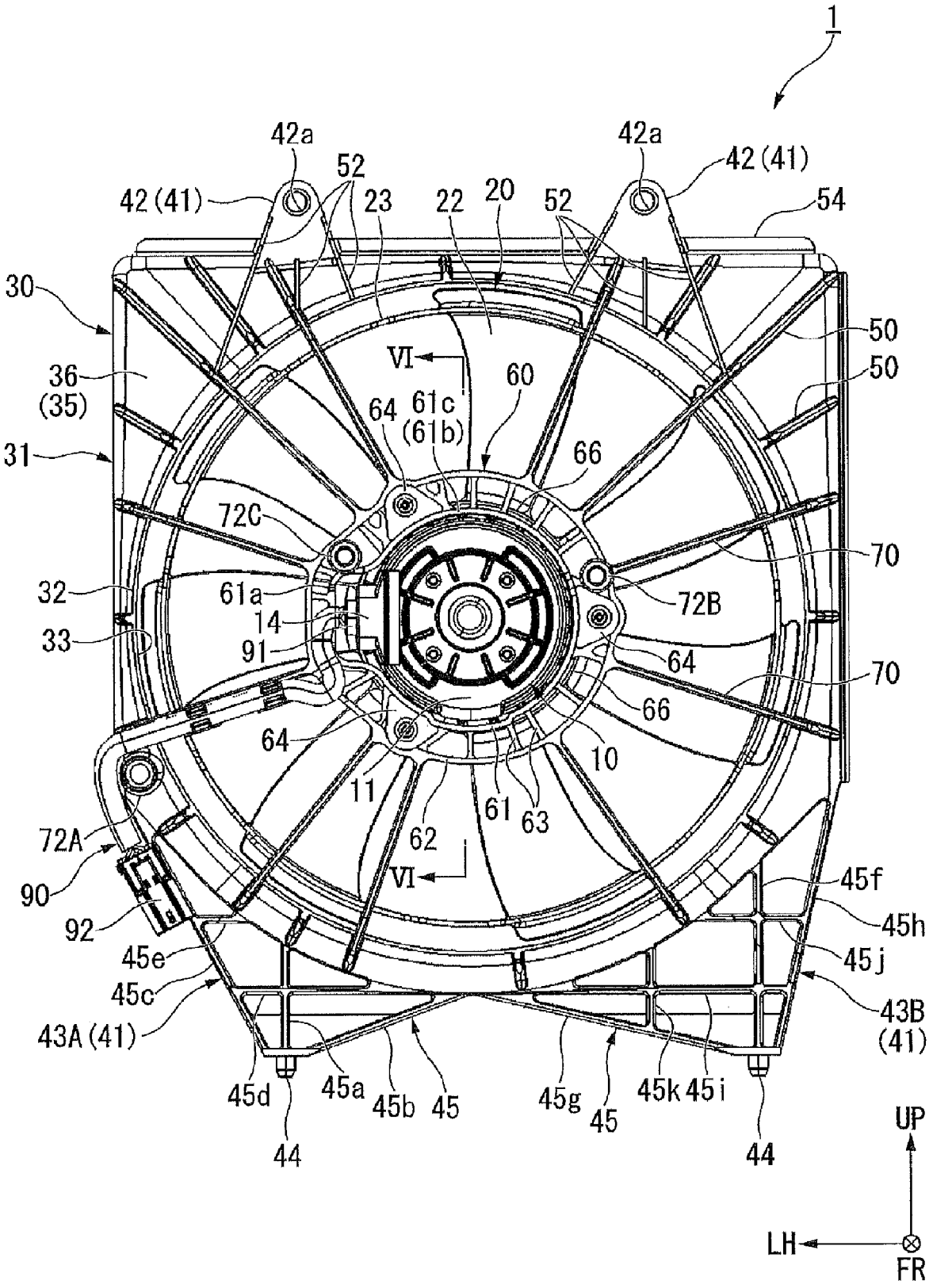
FIG. 5 is a rear view showing the blower device of the embodiment.

FIG. 5 is a rear view of the blower device of the embodiment. Besides, in FIG. 5, a state in which the heat shield plate 80 is removed is illustrated.

As shown in FIG. 5, the motor mounting part 60 is formed to surround the periphery of the motor 10. The motor 10 is fastened and fixed to the motor mounting part 60. The motor mounting part 60 includes an inner cylinder 61 surrounding the back end of the housing 11 of the motor 10 from the radial outer side, an outer cylinder 62 surrounding the inner cylinder 61 from the radial outer side, a plurality of spokes 63 connecting the inner cylinder 61 and the outer cylinder 62, and a motor mounting seat 64 to which the motor 10 is mounted.

Figure 6:
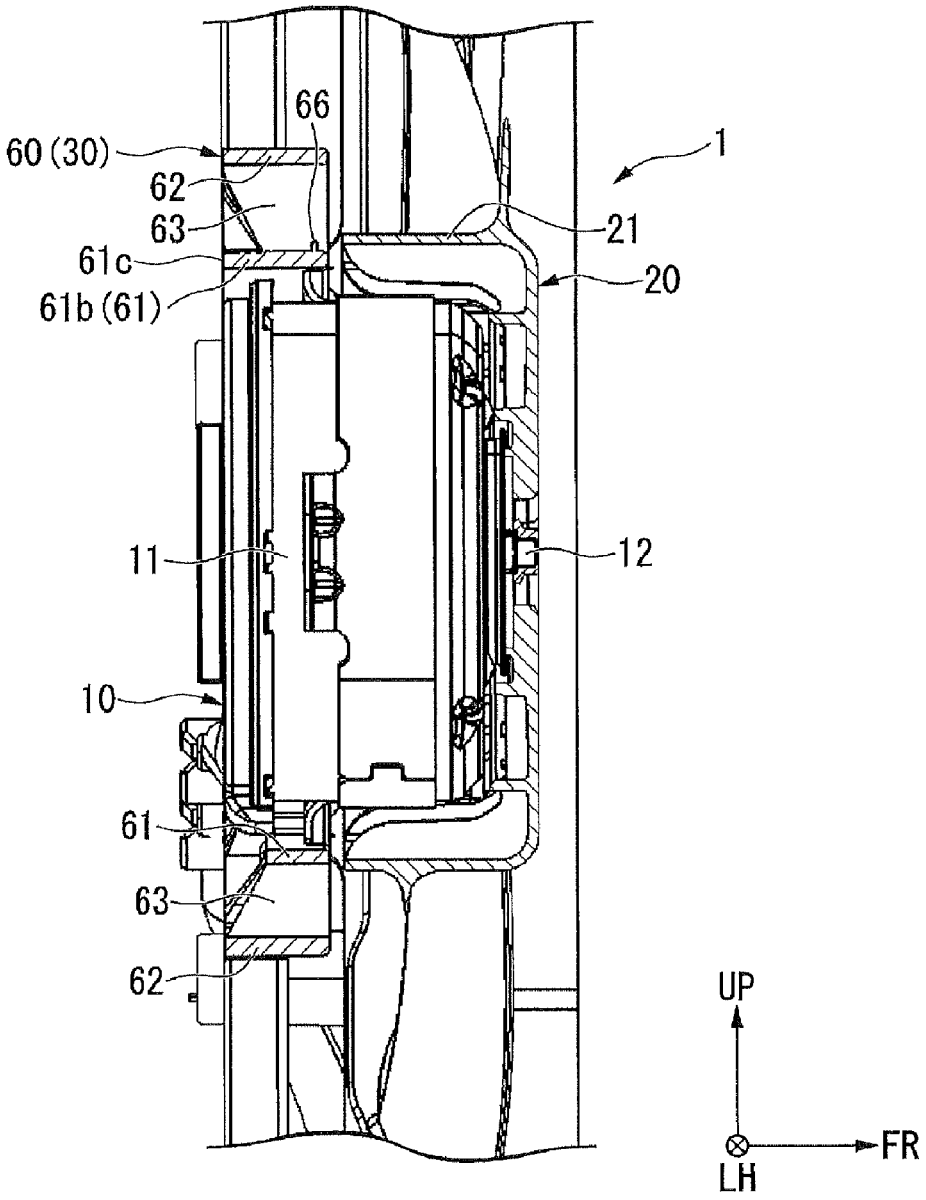
FIG. 6 is a cross-sectional view on a VI-VI line in FIG. 5.

FIG. 6 is a cross-sectional view on a VI-VI line of FIG. 5.

As shown in FIG. 5 and FIG. 6, the inner cylinder 61 is formed in a cylindrical shape coaxial with the output shaft 12 of the motor 10. The inner cylinder 61 surrounds the periphery of the back end of the housing 11 of the motor 10. That is, the inner cylinder 61 surrounds the housing 11 of the motor 10 behind the boss part 21 of the fan 20. In the inner cylinder 61, a diameter expansion part 61*a* is arranged which expands the diameter so as to avoid the motor connector 14 of the motor 10 in a position in the peripheral direction where the inner cylinder 61 overlaps the motor connector 14 of the motor 10.

The inner cylinder 61 includes a top wall 61*b* covering the whole motor 10 in the left-right direction from above. The top wall 61*b* is an upper half of the inner cylinder 61. A back end edge 61*c* of the top wall 61*b* (the end edge on the positive pressure side) is located behind the housing 11 of the motor 10 (the positive pressure side). Besides, the state in which the back end edge 61*c* of the top wall 61*b* is located behind the housing 11 of the motor 10 also includes a state in which the back end edge 61*c* of the top wall 61*b* is aligned with the back end of the housing 11 of the motor 10 in the front-back direction. That is, the top wall 61*b* overlaps the whole back end of the housing 11 of the motor 10 when viewed from the up-down direction. In the embodiment, the back end edge 61*c* of the top wall 61*b* is formed in a position being aligned with the back end of the housing 11 of the motor 10 in the front-back direction, and the back end edge of the lower half of the inner cylinder 61 is formed to be located in front of the back end of the housing 11 of the motor 10. The front end edge of the inner cylinder 61 is formed over the whole periphery in the same position in the front-back direction.

In addition, the inner cylinder 61 includes a stretch part 66 stretching radially outward. The stretch part 66 extends along the peripheral direction. The stretch part 66 is arranged in front of the middle position in the front-back direction of the inner cylinder 61 and behind the front end edge of the inner cylinder 61. The outer diameter of the stretch part 66 is set larger than the inner diameter of the boss part 21 of the fan 20. The stretch part 66 may be arranged over the whole periphery in the peripheral direction, or may be arranged intermittently in the peripheral direction. Besides, desirably, even when the stretch part 66 is arranged intermittently, the outer diameter of the inner cylinder 61 is also set larger than the inner diameter of the boss part 21 of the fan 20 in the part in which the stretch part 66 is not arranged.

The outer cylinder 62 is formed in a cylindrical shape larger in diameter than the inner cylinder 61 coaxial with the output shaft 12 of the motor 10. The outer cylinder 62 is disposed with a space to the inner cylinder 61 in the radial direction. The front end edge of the outer cylinder 62 is formed over the whole periphery in the same position as the front end edge of the inner cylinder 61 in the front-back direction. The back end edge of the outer cylinder 62 is formed over the whole periphery in the same position as the back end edge 61*c* of the top wall 61*b* of the inner cylinder 61 in the front-back direction.

As shown in FIG. 5, the plurality of spokes 63 is formed in a plate shape extending in the front-back direction. The plurality of spokes 63 is respectively connected to the outer peripheral surface of the inner cylinder 61 and the inner peripheral surface of the outer cylinder 62. Each of the plurality of spokes 63 is disposed so that at least a part is spaced apart from the adjacent spoke 63.

As shown in FIG. 6, the forward-directed end surface of each spoke 63 is formed in the same position as the front end edges of the inner cylinder 61 and the outer cylinder 62 in the front-back direction. The backward-directed end on the radial inner side within the end surface of each spoke 63 is formed in the same position as the back end edge of the lower half of the inner cylinder 61 in the front-back direction. The backward-directed end on the radial outer side within the end surface of each spoke 63 is formed in the same position as the back end edge of the outer cylinder 62 in the front-back direction. Accordingly, the spokes 63 are formed so that the dimension in the front-back direction increases gradually from the radial inner side toward the radial outer side.

As shown in FIG. 5, the motor mounting seat 64 is arranged for the same number (three in the embodiment) as the plurality of fastening parts 13 (see FIG. 2) of the motor 10. Each motor mounting seat 64 is arranged in a position corresponding to the plurality of fastening parts 13 of the motor 10. Each motor mounting seat 64 is connected to the inner cylinder 61 and the outer cylinder 62. Viewed from the front-back direction, each motor mounting seat 64 is formed to fill the space between the spokes 63 adjacent to each other in the peripheral direction. In each motor mounting seat 64, the fastening part 13 of the motor 10 is arranged from the front and is fastened and fixed by a screw.

The plurality of stays 70 extends radially from the outer cylinder 62 of the motor mounting part 60 along the radial direction. The end on the radial outer side of each stay 70 is connected to the end on the radial inner side of the main rib 50 of the shroud body 31.

As shown in FIG. 3 and FIG. 4, the plurality of heat shield plate mounting seats 72A, 72B, 72C is arranged on the shroud body 31 and the motor mounting part 60. The plurality of heat shield plate mounting seats 72A, 72B, 72C are the first mounting seat 72A arranged on the shroud body 31, and the second mounting seat 72B and the third mounting seat 72C arranged on the motor mounting part 60. The plurality of heat shield plate mounting seats 72A, 72B, 72C is formed in a columnar shape protruding backward. The plurality of heat shield plate mounting seats 72A, 72B, 72C is respectively arranged in positions corresponding to a heat shield plate fixation part 83 described later of the heat shield plate 80.

As shown in FIG. 1, the heat shield plate 80 is disposed to cover a part of the fan installation hole 33 of the shroud body 31 and at least a part of the motor 10 from the back. For example, the heat shield plate 80 is formed of one metal plate by pressing molding or the like. The heat shield plate 80 includes a main plate 81 facing the fan 20 in the front-back direction, a side wall 82 extending frontward from a part of the outer edge of the main plate 81, and a heat shield plate fixation part 83 fixed to the shroud 30.

The main plate 81 is formed in a tabular shape extending perpendicular to the front-back direction. On the main plate 81, a front surface perpendicular to the front-back direction and facing the plate 22 of the fan 20 is formed. The main plate 81 includes a diameter inner part 85 overlapping the motor 10 when viewed from the front-back direction, and a diameter outer part 86 extending from the diameter inner part 85 to the outside of the cylindrical part 32 of the shroud body 31 along a prescribed radial direction. A boundary between the diameter inner part 85 and the diameter outer part 86 is aligned with the inner peripheral surface of the inner cylinder 61 of the motor mounting part 60 when viewed from the front-back direction. A plurality of beads 81*a* is arranged on the main plate 81. The plurality of beads 81*a* extends parallel to each other over the diameter inner part 85 and the diameter outer part 86 along the prescribed radial direction.

The diameter inner part 85 is formed to cover most of the motor 10 when viewed from the front-back direction. The diameter inner part 85 shields the motor 10 from the engine disposed behind the blower device 1. The upper part of the diameter inner part 85 stretches to a position closer to the radial outer side than the inner peripheral surface of the inner cylinder 61 and closer to the radial inner side than the outer cylinder 62 when viewed from the front-back direction. The lower right part of the diameter inner part 85 is formed to expose the inner side of the inner cylinder 61 when viewed from the front-back direction.

The diameter outer part 86 blocks the flow in the front-back direction of the air delivered by the fan 20 in a position behind the fan 20 (on the positive pressure side). The diameter outer part 86 includes two side edges 86*a*, 86*c* extending along the prescribed radial direction, and a front end edge 86*b* connecting the two side edges 86*a*, 86*c* at the front end of the diameter outer part 86. The two side edges 86*a*, 86*c* are the back side edge 86*a* directed toward the back in the rotation direction (the direction shown by the arrow A in the diagram) of the fan 20, and the front side edge 86*c* directed toward the front in the rotation direction of the fan 20. From the radial inner side toward the radial outer side, the back side edge 86*a* extends toward the front in the rotation direction of the fan 20. From the radial inner side toward the radial outer side, the front side edge 86*c* extends toward the back in the rotation direction. The front end edge 86*b* connects the end of the back side edge 86*a* on the radial outer side and the end of the front side edge 86*c* on the radial outer side. The front end edge 86*b* extends along a direction substantially perpendicular to the prescribed radial direction. The front end edge 86*b* is disposed closer to the outer side than the fan installation hole 33 of the shroud body 31.

As shown in FIG. 3 and FIG. 4, the side wall 82 extends frontward from the outer edge of the diameter outer part 86 along the front-back direction. Accordingly, the side wall 82 suppresses the wind received by the main plate 81 from flowing out of a space in front of the main plate 81. The side wall 82 includes a first side wall 82*a* extending from the back side edge 86*a* of the diameter outer part 86, a second side wall 82*b* extending from the whole front end edge 86*b* of the diameter outer part 86, and a third side wall 82*c* extending from the whole front side edge 86*c* of the diameter outer part 86.

The first side wall 82*a* extends from a place in the back side edge 86*a* of the diameter outer part 86, the place covering a range from the middle portion in the radial direction to the end on the radial inner side. The end of the first side wall 82*a* on the radial outer side is arranged closer to the radial outer side than the outer cylinder 62 of the motor mounting part 60. The second side wall 82*b* and the third side wall 82*c* are connected to each other. Following the shape of the front side edge 86*c* of the diameter outer part 86, the third side wall 82*c* is directed from the radial outer side toward the radial inner side as the third side wall 82*c* is directed from the back toward the front in the rotation direction of the fan 20.

According to this configuration, the heat shield plate 80 has a place in the main plate 81 in which the side wall 82 is not arranged, the place being on the back side in the rotation direction of the fan 20. In other words, a communication portion 88 in communication with the rotation direction of the fan 20 is formed on the first side wall 82*a*.

The heat shield plate fixation part 83 includes a first heat shield plate fixation part 83*a* fixed to the shroud body 31, and a second heat shield plate fixation part 83*b* and a third heat shield plate fixation part 83*c* fixed to the motor mounting part 60. The heat shield plate fixation part 83 stretches radially outward after extending frontward from the side edge of the main plate 81. A through hole through which a screw is threaded is formed in the heat shield plate fixation part 83. The first heat shield plate fixation part 83*a* is arranged at the end of the diameter outer part 86 on the radial outer side. A part of the first heat shield plate fixation part 83*a* is shared with the second side wall 82*b*. The first heat shield plate fixation part 83*a* is fastened and fixed to the first mounting seat 72A arranged in the shroud body 31. The second heat shield plate fixation part 83*b* is arranged at the end of the heat shield plate 80 opposite to the first heat shield plate fixation part 83*a*, and the second heat shield plate fixation part 83*b* is fastened and fixed to the second mounting seat 72B arranged in the motor mounting part 60. The third heat shield plate fixation part 83*c* is arranged at the end of the diameter outer part 86 on the radial inner side. A part of the third heat shield plate fixation part 83*c* is shared with the first side wall 82*a*. The third heat shield plate fixation part 83*c* is fastened and fixed to the third mounting seat 72C arranged in the motor mounting part 60.

As shown in FIG. 5, in the wire harness 90, a connector 91 at one end is connected to the motor connector 14 of the motor 10, and a connector 92 at the other end is held by the connector holding part 48 (see FIG. 4). The wire harness 90 is disposed between the inner cylinder 61 and the outer cylinder 62 of the motor mounting part 60 in the order from one end to the other end, and then extends radially outward while being held by the stay 70 arranged in a position overlapping the heat shield plate 80 (see FIG. 1) when viewed from the axial direction.

Next, an operation of the blower device 1 in the embodiment is described.

In the blower device 1, by rotating the fan 20, a wind flows inside the fan installation hole 33 from the front to the back. The motor mounting part 60 is arranged inside the fan installation hole 33 when viewed from the front-back direction. In the embodiment, since the motor mounting part 60 includes the inner cylinder 61 and the outer cylinder 62 which are connected by the plurality of spokes 63, it is possible to make air flow between the inner cylinder 61 and the outer cylinder 62. Accordingly, the air delivery performed by the fan 20 is suppressed from being blocked by the motor mounting part 60, and the air delivery rate can be secured.

Figure 7:
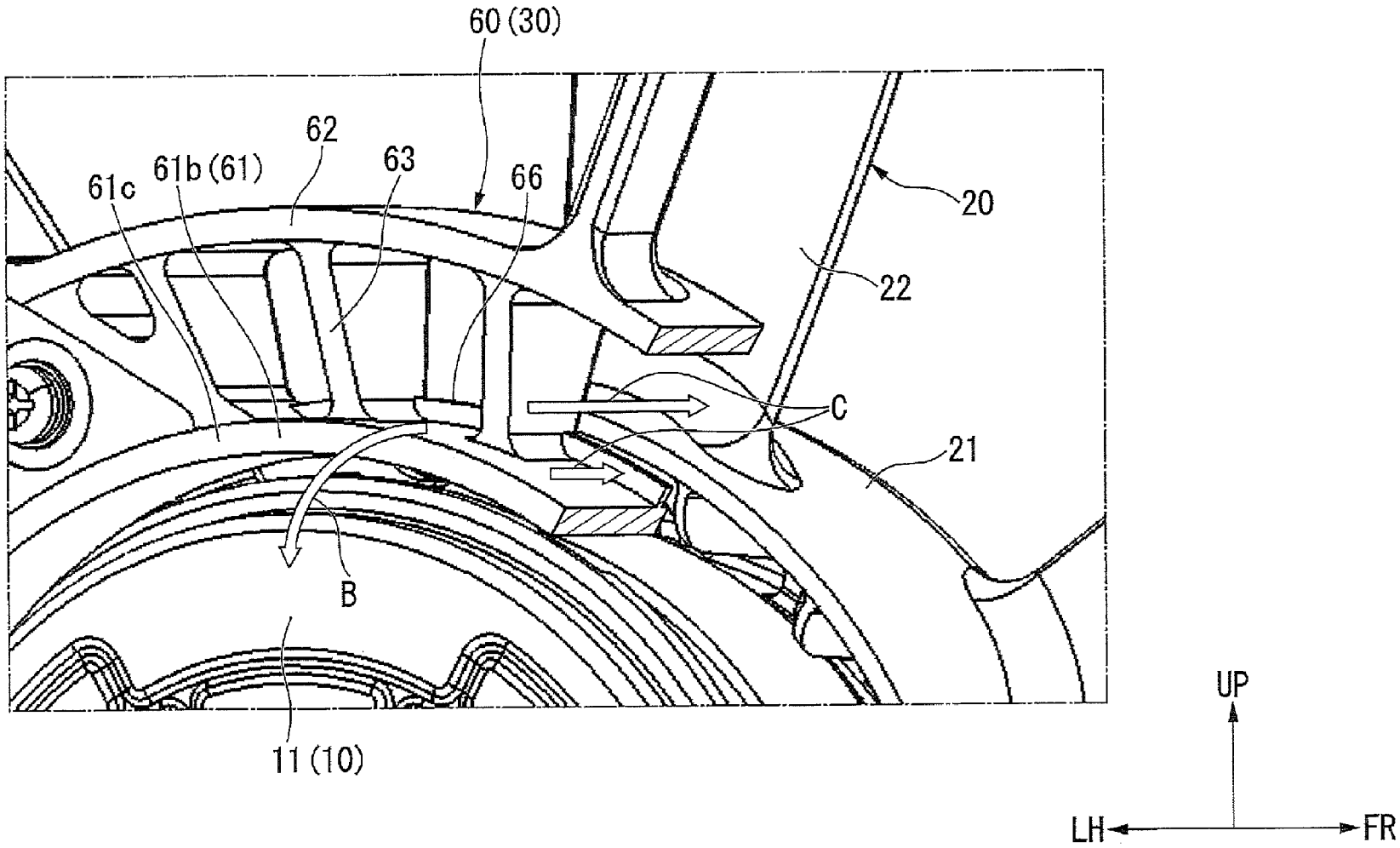
FIG. 7 is an enlarged perspective view showing the blower device of the embodiment.

FIG. 7 is an enlarged perspective view of the blower device of the embodiment. Besides, in FIG. 7, a state is illustrated in which a part of the shroud 30 is broken and the heat shield plate 80 is removed.

The inner cylinder 61 of the motor mounting part 60 includes the top wall 61*b* covering the motor 10 from above, and the back end edge 61*c* of the top wall 61*b* is located behind the housing 11 of the motor 10. Therefore, as shown by an arrow B in FIG. 7, due to the air flowing from the front toward the back, the water falling from the back end edge 61*c* of the top wall 61*b* falls to the back of the housing 11 of the motor 10. Accordingly, the water covering the motor 10 can be reduced.

Furthermore, on the outer peripheral surface of the inner cylinder 61, the stretch part 66 which stretches radially outward and extends along the peripheral direction is arranged. Accordingly, as shown by an arrow C in FIG. 7, the water splashing along the front-back direction at the radial outer side of the outer peripheral surface of the inner cylinder 61 can be received by the stretch part 66. Thereby, the water splashing from the inner cylinder 61 side toward the boss part 21 side of the fan 20 in the front-back direction can be suppressed from entering the space between the boss part 21 and the motor 10. Accordingly, the water covering the motor 10 can be reduced.

As described above, it is possible to provide the blower device 1 capable of securing the air delivery rate and reducing the water covering the motor 10.

Besides, the present invention is not limited to the above embodiment described with reference to the diagrams, and various variants are conceivable in the technical scope of the present invention.

For example, in the above embodiment, the blower device is used in cooling of the radiator, but the blower device of the present invention is not limited to the use in the cooling of the radiator, and may also be used to cool other equipment.

In addition, in the above embodiment, the blower device is disposed on the vehicle back side of the radiator, but the blower device may also be disposed on the vehicle front side of the radiator and the air blown by the blower device is supplied to the radiator.

Moreover, in the range not deviating from the gist of the present invention, the components in the above embodiment can be appropriately substituted to known components.

What is claimed is:

1. A blower device, comprising:

a drive source having an output shaft and a housing;

a fan connected to the output shaft and rotationally driven by the drive source; and a shroud having a shroud body in which a fan installation hole for accommodating the fan is formed, and having a drive source mounting part which is arranged inside the fan installation hole when viewed in an axial direction of the output shaft and to which the drive source is mounted;

wherein the fan comprises a boss part which is formed in a bottomed cylindrical shape and which is disposed to cover the drive source from one side in the axial direction of the output shaft;

the drive source mounting part comprises:

an inner cylinder disposed closer to the other side in the axial direction than the boss part and surrounding a periphery of the drive source from a radial outer side of the output shaft;

an outer cylinder surrounding the inner cylinder from the radial outer side; and a plurality of spokes connecting the inner cylinder and the outer cylinder; and a stretch part which stretches toward the radial outer side of the output shaft and extends along a peripheral direction of the output shaft is formed on an outer peripheral surface of the inner cylinder, wherein the stretch part is arranged in front of a middle position in a front-back direction of the inner cylinder and behind a front end edge of the inner cylinder, and an outer diameter of the stretch part is set larger than an inner diameter of the boss part of the fan.

2. The blower device according to claim 1, wherein the inner cylinder comprises a top wall covering the drive source from above in a state that the shroud is fixed;

an end edge of the top wall, which is located on a positive pressure side when the fan is being rotated, is located closer to the positive pressure side than the housing, or the end edge of the top wall, which is located on a positive pressure side when the fan is being rotated, is located at the same position as the housing in the axial direction of the output shaft.

3. The blower device according to claim 1, further comprising a connector that is electrically connected to the drive source, wherein the inner cylinder comprises a diameter expansion part, and the connector is arranged in the diameter expansion part of the inner cylinder.

4. The blower device according to claim 2, further comprising a connector that is electrically connected to the drive source, wherein the inner cylinder comprises a diameter expansion part, and the connector is arranged in the diameter expansion part of the inner cylinder.

5. The blower device according to claim 1, wherein each of plurality of spokes is formed so that a dimension increases in a direction from the inner cylinder toward the outer cylinder.

6. The blower device according to claim 2, wherein each of plurality of spokes is formed so that a dimension increases in a direction from the inner cylinder toward the outer cylinder.

7. The blower device according to claim 3, wherein each of plurality of spokes is formed so that a dimension increases in a direction from the inner cylinder toward the outer cylinder.

8. The blower device according to claim 1, wherein at least one mounting seat of the driving source connecting to the inner cylinder and the outer cylinder is formed in plural, and the plural mounting seats are respectively arranged between the plurality of spokes.

9. The blower device according to claim 2, wherein at least one mounting seat of the driving source connecting to the inner cylinder and the outer cylinder is formed in plural, and the plural mounting seats are respectively arranged between the plurality of spokes.

10. The blower device according to claim 3, wherein at least one mounting seat of the driving source connecting to the inner cylinder and the outer cylinder is formed in plural, and the plural mounting seats are respectively arranged between the plurality of spokes.

11. The blower device according to claim 5, wherein at least one mounting seat of the driving source connecting to the inner cylinder and the outer cylinder is formed in plural, and the plural mounting seats are respectively arranged between the plurality of spokes.

* * * * *